US005398351A

United States Patent [19]

Watson

[11] Patent Number: 5,398,351

[45] Date of Patent: Mar. 21, 1995

[54] ABOVE-GROUND POOL UNDERLAYMENT PANELS

[76] Inventor: Paul R. Watson, 66 Vermilion Way, Levittown, Pa. 19054

[21] Appl. No.: 141,523

[22] Filed: Oct. 27, 1993

[51] Int. Cl.[6] ..... E02D 27/00

[52] U.S. Cl. ..... 4/506; 52/169.7; 52/309.4

[58] Field of Search ..... 52/168, 169.7, 309.4, 52/309.7; 4/506, 488

[56] References Cited

U.S. PATENT DOCUMENTS 3,429,085 2/1969 Stillman, Jr. ..... 52/309.8 X
5,081,810 1/1992 Emmert ..... 52/309.4
5,410,603 4/1991 Hertzog ..... 52/169.7 X

*Primary Examiner*—Carl D. Friedman
*Assistant Examiner*—Creighton Smith
*Attorney, Agent, or Firm*—Gregory J. Gore

[57] ABSTRACT

A group of modular planar structural foam sections are laid on the ground directly underneath the liner of an above-ground pool. The foam panels are cut so that they fit tightly side-by-side covering all areas within the frame. The joints between the panels are then filled by caulking and taped over to smooth the top surface of the joints. The result is an improved pool underlayment system which provides many advantages, including cushioning of swimmer impact to help prevent shallow diving injuries.

9 Claims, 3 Drawing Sheets

ABOVE-GROUND POOL UNDERLAYMENT PANELS

FIELD OF THE INVENTION

This invention relates to the construction of an above-ground swimming pool. More specifically, it relates to a composition used underneath the bottom of the pool.

BACKGROUND OF THE INVENTION AND DESCRIPTION OF PRIOR ART

Above-ground swimming pools have been used for many years and are popular, often preferred over permanent in-ground pools because of their low cost and portability. Typically, above-ground swimming pools include an outside metal frame with decking around the perimeter. The frame sets directly on the ground which is prepared to receive the frame and support the liner in the middle. The top of the frame holds a flexible liner which is supported on the bottom by the ground. Structural side walls of the pool are supported by the frame and also retain the liner.

Preparation of the ground area beneath the pool liner includes leveling the earth and then covering it with a loose substance that will evenly support the weight of the water-filled liner. Soft substances, such as peat moss, vermiculite or sand are commonly used as a fill material which is placed on the ground underneath the pool liner. The softness of this underlayment material protects the flexible pool liner from contact with sharp objects and will accept some deformation by a person standing on it so that tears and leaks from foot pressure are minimized.

These prior art underlayment materials, however, are less than ideal because problems with leaks still persist. The loose materials often settle or become washed out, and sharp stones underneath are often revealed which then tear the pool liner. The loose materials also do not fully protect against roots and weeds growing up through the material, which can similarly cause leaks. An additional problem is that the loose material often becomes wetted by ground water and retains this water along the area of the metal support frame, causing the frame to rust and corrode prematurely. Furthermore, the soft materials often retain foot print impressions made by occupants of the pool which detracts from the aesthetic appearance and desirability of having a smooth, flat, bottom surface. Finally, because above-ground pools are inherently shallow, there is a need for an underlayment which cushions swimmer impact. There is therefore a need in the art for an above-ground swimming pool underlayment system which solves these problems.

SUMMARY OF THE INVENTION

In order to meet the needs in the swimming pool arts for an improved pool bottom underlayment, the present invention has been devised. This new system includes a plurality of planar structural foam sections which are laid down on the prepared earth inside of the frame before the liner is put down. The foam panels are cut so they fit tightly side-by-side covering all areas within the frame. The joints between the panels may be filled by caulking and then taped over to smooth the top surface of the joints.

This simple system cures all of the problems with the prior art pools cited above and yields many additional advantages. For example, the structural foam panels are lightweight and extremely easy to install. They are portable and may be taken up and reused if the pool is moved. They provide a smooth, flat surface to the bottom of the pool, while protecting against any natural upgrowth. Because unlike loose material, the panels possess structural surface strength, they do not take permanent footprints. Also, the foam panels do not retain moisture that can corrode the metal frame and, of course, they cannot wash out.

Testing of this underlayment system has revealed a swimming pool construction which demonstrates no leaks and most importantly, provides an extremely safe bottom structure which cushions swimmer impact. Diving safety is an extremely serious problem in swimming pool use, and many injuries occur from shallow diving accidents when the diver impacts the bottom of the pool. The underlayment system of the present invention provides an added degree of safety because, unlike sand or other loose underlayment materials, greater impact cushioning is provided.

Other objects, advantages and novel features of the invention will become apparent from the following detailed description of the invention when considered in conjunction with the accompanying drawings.

DESCRIPTION OF THE PREFERRED EMBODIMENT

Figure 1:
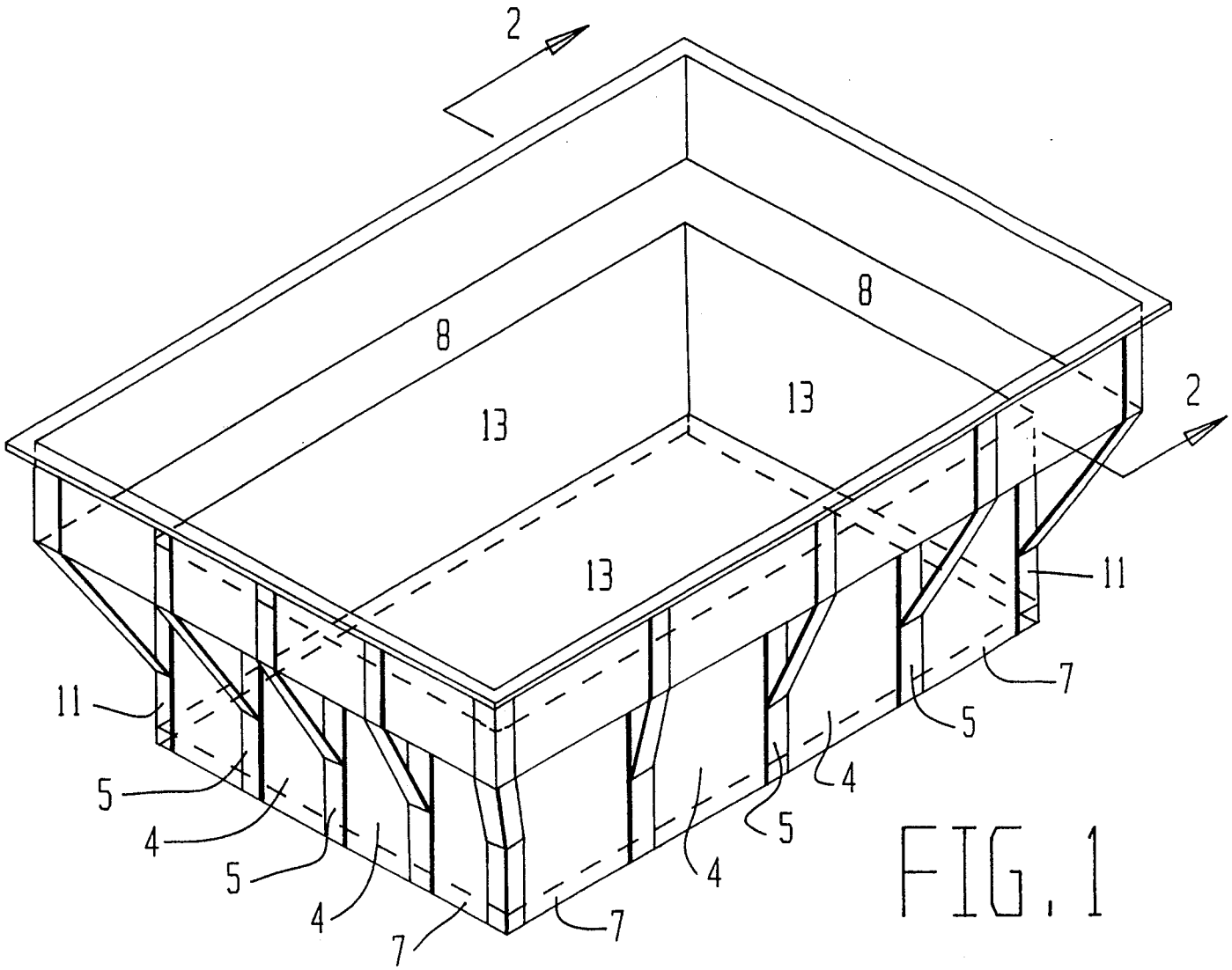
FIG. 1 is a top left front isometric view of a rectangular above-ground swimming pool which includes the underlayment system of the present invention.

Referring now to FIG. 1, a typical rectangular above-ground pool is shown. The frame 11 includes a plurality of vertical side posts 5 which support a perimeter decking 8 at the top. Side walls 4 hold the liner 13 which contains the water within the area inside of the frame. The underlayment system 7 of the present invention shown by the dotted lines is positioned within the frame on the ground under the liner.

Figure 2:
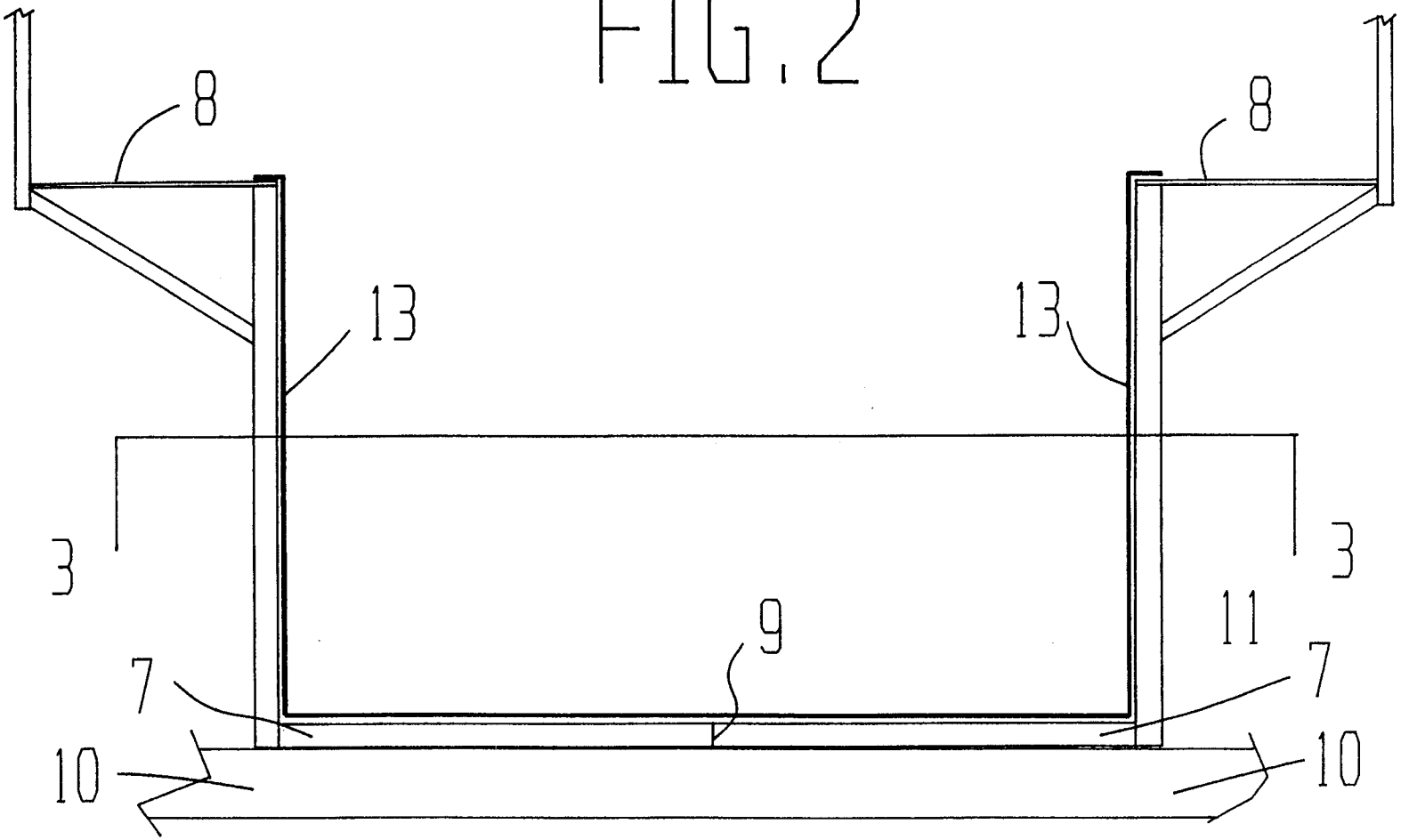
FIG. 2 is a side-sectional view taken from FIG. 1 as shown in that figure.
Figure 3:
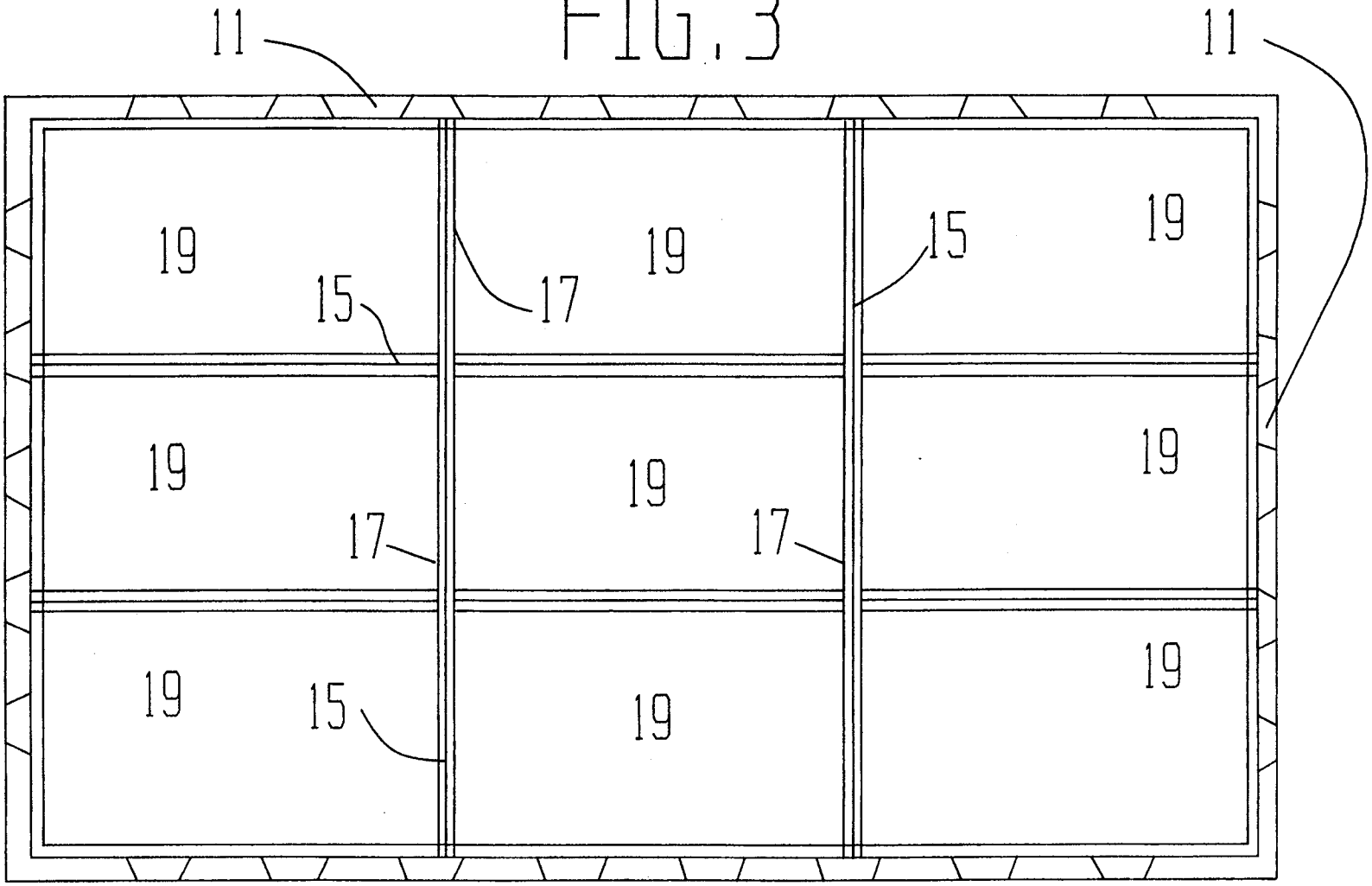
FIG. 3 is a top sectional view showing the modular nature of the underlayment panels.

Referring now to FIG. 2, a sectional view of FIG. 1 is shown. The modular foam panels of the present invention are fitted together along joint 9 and abut the bottom edges of the frame 11 around the periphery of the pool so that all of the ground area 10 within the frame is completely covered. The panels are situated directly between the bottom of the liner and the ground. Liner 13 covers all inner surfaces for waterproofing. FIG. 3 shows a top view in which six panels 19 are employed to cover the bottom of the pool. The joints between the panels may be filled with caulking 15 and adhesive tape 17 across the top surface in order to smooth the surface of the joints.

The preferred material of the panels is expandable polystyrene which is approximately two inches thick. Testing has shown that this material exhibits properties which are excellent for the desired attributes of an above-ground pool underlayment system. The polystyrene has very low water absorption and it is strong enough to support swimmer foot pressure and the weight of the pool water, while providing the added degree of safety by offering a cushion against swimmer impact. The panels also provide a bottom surface to the pool which is smooth and flat. Footprints initially appear, however, the polystyrene material is resilient and with the pressure from the water, the deformations soon disappear and the material returns to its initial shape. The expandable polystyrene is also environmentally safe and it is non-toxic to any natural growth around it. The specific shape or dimensions of the sheets are not critical to the invention, but a four foot by eight foot dimension is sufficient to cover a large area with a few number of sheets, yet is small enough for easy handling.

The method of constructing an above-ground swimming pool according to the present invention, comprises: grading the surface of the earth in the area that the pool occupies so that the earth is smooth and level; erecting a frame on the prepared earth around the periphery of the area defining the pool; placing a plurality of modular foam panels on the earth within the frame; affixing a liner within the frame, the liner resting directly on the foam panels and being waterproof to provide the containment of a body of water for swimming.

It will be apparent to those of skill in the pool arts that all of the above-mentioned objects of the present invention have been achieved by this modular expanded foam underlayment system. The major problem of leakage due to liner tears is vastly reduced, if not completely eliminated. The added safety feature of a cushioned bottom to guard against injuries due to diving impact is also provided.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. An above-ground swimming pool, comprising:

a frame defining an enclosed area supported by the ground;

a waterproof liner supported by said frame and said ground within said area, whereby said liner receives water to provide a contained body of water for swimming; and a plurality of structural foam planar panels located directly between the bottom of said liner and said ground.

2. The above-ground swimming pool of claim 1, further described in that said panels cover substantially all the area within said frame.

3. The above-ground swimming pool of claim 2, wherein said panels are composed only of expandable polystyrene.

4. The above-ground swimming pool of claim 3, wherein said panels are approximately two inches thick.

5. The above-ground swimming pool of claim 4, wherein said panels are rectangular and are approximately four feet wide by eight feet long.

6. The above-ground swimming pool of claim 5, further described in that the panels are in directly abutting relationship and have joints between adjacent panels.

7. The above-ground swimming pool of claim 6, further including adhesive tape laid on the top side of said panels over said joints.

8. The method of constructing an above-ground swimming pool, comprising:

grading the surface of the earth in the area that said pool will occupy so that said earth is smooth and level;

erecting a frame on said earth around the periphery of said area defining said pool;

placing a plurality of modular foam panels on said earth within said frame; and affixing said liner within said frame, said liner resting directly on said foam panels, and said liner being waterproof and providing the containment of a body of water for swimming.

9. An above-ground swimming pool, comprising:

a frame defining an enclosed area supported by the ground;

a waterproof liner supported by said frame and said ground within said area, whereby said liner receives water to provide a contained body of water for swimming;

a plurality of modular foam planar panels in abutting relationship located directly between the bottom of said liner and said ground, and covering substantially all the area within said frame; and a plurality of joints between said panels, including adhesive tape laid on the top side of said panels over said joints.

* * * * *